US007857027B2

(12) United States Patent
Nitta

(10) Patent No.: US 7,857,027 B2
(45) Date of Patent: Dec. 28, 2010

(54) APPARATUS FOR MANUFACTURING SINGLE FACED CORRUGATED PASTEBOARD

(75) Inventor: Takashi Nitta, Mihara (JP)

(73) Assignee: Mitsubishi Heavy Industries Printing & Packaging Machinery, Ltd., Mihara-Shi, Hiroshima (JP)

( * ) Notice: Subject to any disclaimer, the term of this patent is extended or adjusted under 35 U.S.C. 154(b) by 431 days.

(21) Appl. No.: 11/883,172

(22) PCT Filed: Feb. 27, 2006

(86) PCT No.: PCT/JP2006/303581

§ 371 (c)(1),
(2), (4) Date: Sep. 13, 2007

(87) PCT Pub. No.: WO2006/090875

PCT Pub. Date: Aug. 31, 2006

(65) Prior Publication Data

US 2008/0308233 A1 Dec. 18, 2008

(30) Foreign Application Priority Data

Feb. 25, 2005 (JP) ..... 2005-051382

(51) Int. Cl.
*B31F 1/28* (2006.01)

(52) U.S. Cl. ..... 156/472

(58) Field of Classification Search ..... None
See application file for complete search history.

(56) References Cited

U.S. PATENT DOCUMENTS 4,373,712 A * 2/1983 Mitzel ..... 271/272
4,385,700 A * 5/1983 Hodges et al. ..... 209/539
5,344,520 A * 9/1994 Seki et al. ..... 156/472
5,415,273 A * 5/1995 Peterson ..... 198/831
5,870,889 A * 2/1999 Togoshi et al. ..... 56/320.2
5,951,817 A * 9/1999 Thomas ..... 156/472
6,478,066 B1 * 11/2002 Rossi et al. ..... 156/472

FOREIGN PATENT DOCUMENTS

DE 44 30 785 A1 3/1995
DE 44 13 775 A1 10/1995

(Continued)

*Primary Examiner*—Richard Crispino
*Assistant Examiner*—Barbara J. Musser
(74) *Attorney, Agent, or Firm*—Kanesaka Berner & Partners

(57) ABSTRACT

The present invention relates to a single faced corrugated pasteboard manufacturing apparatus. To considerably reduce running costs and insufficient bonding of a single faced corrugated pasteboard sheet and occurrence of wrinkles due to an enlargement in machine width, there is provided a single faced corrugated pasteboard manufacturing apparatus for corrugating a medium 1 between a pair of corrugated rolls 4 and 5, supporting the corrugated medium 1 on a surface of the corrugated roll 4, and bonding a liner board 2 on the medium 1 being supported to manufacture a single faced corrugated pasteboard sheet 3. The apparatus includes a pair of facing rolls 21 and 22 provided to face the corrugated roll 4 and rotatable in the same direction as the corrugated roll 4; and a plurality of endless members 23, wound around the pair of facing rolls 21 and 22 in an axial direction of the facing rolls, for pressing the liner board 2 against the medium 1 being supported on the surface of the corrugated roll 4.

16 Claims, 8 Drawing Sheets

FOREIGN PATENT DOCUMENTS

| | | | |
|---|---|---|---|
| JP | H04-221626 | A | 8/1992 |
| JP | H06-55675 | | 3/1994 |
| JP | H06-320650 | A | 11/1994 |
| JP | H07-68668 | A | 3/1995 |
| JP | H07-285186 | A | 10/1995 |
| JP | H11-10756 | A | 1/1999 |
| JP | H11-105171 | A | 4/1999 |
| JP | 2000-901 | A | 1/2000 |

* cited by examiner

APPARATUS FOR MANUFACTURING SINGLE FACED CORRUGATED PASTEBOARD

TECHNICAL FIELD

The present invention relates to a single faced corrugated pasteboard manufacturing apparatus that glues a liner board and a corrugated medium together to manufacture a single faced corrugated pasteboard sheet.

BACKGROUND ART

FIG. 5 is a side view schematically showing a conventional single faced corrugated pasteboard manufacturing apparatus. As shown in FIG. 5, the single faced corrugated pasteboard manufacturing apparatus is equipped with a corrugating unit 10 for corrugating a medium 1; a glue machine 11 for coating the medium 1 corrugated by the corrugating unit 10 with glue; and a pressure unit 100 for pressing a liner board 2 against the medium 1 coated with glue by the glue machine 11 to glue the liner board 2 on the medium 1.

The corrugating unit 10 is equipped with a pair of upper and lower corrugated rolls 4 and 5 arranged so as to face each other. The surfaces of the upper corrugated roll 4 and lower corrugated roll 5 are each corrugated in the circumferential direction, and at the nip between the upper corrugated roll 4 and the lower corrugated roll 5, the ridge 4*a* of the upper corrugated roll 4 meshes with the groove 5*b* of the lower corrugated roll 5, and the groove 4*b* of the upper corrugated roll 4 meshes with the ridge 5*a* of the lower corrugated roll 5. The medium 1 goes approximately horizontally to the nip between the upper corrugated roll 4 and the lower corrugated roll 5, and is corrugated therebetween. Note that the upper corrugated roll 4 and lower corrugated roll 5 contain steam inside, so that the surfaces of the upper corrugated roll 4 and lower corrugated roll 5 have been heated.

The glue machine 11 is equipped with a glue reservoir 8 for storing glue; a bonding roll 6 for coating the ridges of the medium 1 wound around the upper corrugated roll 4 with the glue of the glue reservoir 8; and a scraping roll 7 with a projected scraper 7*a* for scraping glue off the surface of the bonding roll 6 as needed.

The pressure unit 100 is equipped with a belt roll 101 and a stretch roll 102 which are provided to face the upper corrugated roll 4; and a belt (endless belt) 103 wound around the belt roll 101 and stretch roll 102. The belt 103 is pressed against a predetermined circumferential region (nip region) of the upper corrugated roll 4 and rotates along with the upper corrugated roll 4. Therefore, in the predetermined region, the liner board 2 is pressed against the medium 1 so that the liner board 2 is glued on the medium 1. In this manner, a single faced corrugated pasteboard sheet 3 is manufactured.

Note that such a single faced corrugated pasteboard manufacturing apparatus is disclosed, for example, in Patent Documents 1 and 2.

Patent Document 1: Japanese Patent Laid-Open Publication No. Hei 11-105171

Patent Document 2: Japanese Patent No. 2622330

DISCLOSURE OF THE INVENTION

Problems to be Solved by the Invention

By the way, in the above-described conventional single faced corrugated pasteboard manufacturing apparatus, the belt 103 of the pressure unit 100 is formed as a continuous wide belt (about 2 to 3 min width) extending from one end to another end in the axial direction (machine width direction or width direction) of the belt roll 101 and stretch roll 102. Because of this, there is a problem that the belt 103 is complex in structure and method of manufacture and high in cost. In addition, even in the case where the belt 103 is partially damaged, the entire belt 103 has to be interchanged and therefore the running costs are increased.

When there is a difference in circumferential length in the width direction of the belt 103 due to errors at the time of manufacture, the circumferentially short part of the belt 103 makes one rotation earlier than the circumferentially long part and therefore the belt is twisted gradually. As a result, if the belt 103 continues to rotate, it will be damaged finally. Hence, in prior art, for example, preceding quantities of the transversely opposite end portions of the belt 103 are measured, and if one end portion in the width direction of the belt 103 precedes the other end a prescribed value or greater, pressure applied to the belt 103 is increased so that the circumferential length of the one end in the width direction of the belt 103 is extended, whereby the preceding quantity is reduced to less than the prescribed quantity. However, this method requires a mechanism of controlling the preceding quantity of the belt 103 which increases the manufacturing costs. In addition, when an abnormality occurs in the control mechanism, there are cases where the machine is stopped or the belt 103 is damaged.

Furthermore, since the transversely central portions of the belt roll 101 and stretch roll 102 deflect in a direction where they move toward each other by tension of the belt 103, a traveled length of the transversely central portion of the belt 103 becomes shorter than that of the transversely opposite end portions and therefore the transversely central portion of the belt 103 makes one rotation earlier than the transversely opposite end portions and precedes. Because of this, the weft of the textile structure of the belt 103 is curved and the belt width is reduced to less than the required width.

Hence, in prior art, for example, by forming the diameter of the transversely central portion of the belt roll 101 or stretch roll 102 so that it becomes smaller than that of the transversely opposite end portions (i.e., by forming a negative crown shape in which the transversely central portions of the belt roll 101 and stretch roll 102 are reduced in diameter), the circumferential speed of the transversely opposite end portions of the belt 103 is made faster than that of the transversely central portion to reduce the preceding quantity of the transversely central portion of the belt 103, whereby the width shrinkage of the belt 103 is suppressed.

The amount of a negative crown-shaped portion that is added to the belt roll 101 or stretch roll 102 needs to be increased according to an increase in a bending quantity of each of the belt roll 101 and stretch roll 102. However, in this case, if the machine width is enlarged, bending of the belt roll 101 and stretch roll 102 will increase and therefore it will become necessary to increase the amount of the negative crown-shaped portion of the belt roll 101 or stretch roll 102 in order to adapt to the increased bending. Because of this, the amount that the transversely central portion of the belt 103 is stretched is reduced compared with the transversely opposite end portions. As a result, the nip pressure to be applied to the transversely central portion is reduced and there is a possibility that insufficient bonding will take place in the transversely central portion of the a single faced corrugated paste board sheet 3. Because the circumferential speed of the transversely opposite end portions of the belt 103 is faster than that of the transversely central portion, there is another possibility that the liner board 2 on the transversely opposite end portions will be shifted and therefore insufficient bonding will occur in the transversely opposite end portions.

The present invention has been made in view of the problems described above. Accordingly, it is the object of the present invention to provide a single faced corrugated pasteboard manufacturing apparatus that is capable of considerably reducing running costs, and insufficient bonding of a single faced corrugate pasteboard sheet and occurrence of wrinkles due to an enlargement in machine width.

Means for Solving the Problems

To achieve the above object of the present invention and in accordance with the present invention as set forth in a first aspect, there is provided a single faced corrugated pasteboard manufacturing apparatus for corrugating a medium between a pair of corrugated rolls, supporting the corrugated medium on a surface of one corrugated roll of the pair of corrugated rolls, and bonding a liner board on the medium being supported to manufacture a single faced corrugated pasteboard sheet. The single faced corrugated pasteboard manufacturing apparatus comprises a pair of facing rolls provided to face the one corrugated roll and rotatable in the same direction each other; and a plurality of endless members, wound around the pair of facing rolls in an axial direction of the facing rolls, for pressing the liner board against the medium being supported on the surface of the one corrugated roll.

In the single faced corrugated pasteboard manufacturing apparatus of the present invention as set forth in a second aspect, each of the endless members is formed into the shape of a plate. The plate shape used herein means that the width of a member is larger or sufficiently larger than the thickness. For instance, it may be a belt or ribbon shape.

In the single faced corrugated pasteboard manufacturing apparatus of the present invention as set forth in a third aspect, each of the endless members is formed into the shape of a line. The line shape used herein means that the width of a member is approximately the same as the thickness, or it is smaller than the thickness.

In the single faced corrugated pasteboard manufacturing apparatus of the present invention as set forth in a fourth aspect, the pair of facing rolls have a plurality of grooves formed axially in their peripheral surfaces, and the endless members are wound around the pair of facing rolls so that they fit in the grooves of the pair of facing rolls.

The single faced corrugated pasteboard manufacturing apparatus of the present invention as set forth in a fifth aspect further comprises a fall preventing member, provided in close proximity to at least one of the pair of facing rolls, for preventing the endless members from falling off the grooves of the pair of facing rolls.

In the single faced corrugated pasteboard manufacturing apparatus of the present invention as set forth in a sixth aspect, the fall preventing member is a guide roll arranged in parallel to the pair of facing rolls and having lands formed on its peripheral surface so as to fit in the grooves.

The single faced corrugated pasteboard manufacturing apparatus of the present invention as set forth in a seventh aspect further comprises:

one or more track guide rolls, provided in parallel to the pair of facing rolls, for supporting the plurality of endless members and guiding tracks of the plurality of endless members;

the one or more track guide rolls causing adjacent endless members of the plurality of endless members to travel on tracks which partially differ from each other; and a movement regulating guide member, provided to one side of a different track portion of the track of each of the endless members which differs from the track of an adjacent endless member, for regulating axial movement of the endless member.

In the single faced corrugated pasteboard manufacturing apparatus of the present invention as set forth in an eighth aspect, the track guide rolls comprise a first track guide roll having a first cylindrical guide surface for guiding the endless members to a first track, and a second track guide roll having a second cylindrical guide surface for guiding the endless members to a second track;

the first track guide roll guides tracks of alternate endless members of the plurality of endless members; and the second track guide roll guides tracks of the remaining alternate endless members of the plurality of endless members.

In the single faced corrugated pasteboard manufacturing apparatus of the present invention as set forth in a ninth aspect, the first and second cylindrical guide surfaces are equal in radius to each other.

In the single faced corrugated pasteboard manufacturing apparatus of the present invention as set forth in a tenth aspect, the track guide roll has a plurality of first cylindrical guide surfaces alternately arranged axially for guiding the endless members to a first track, and a plurality of second cylindrical guide surfaces alternately arranged axially for guiding the endless members to a second track;

the first cylindrical guide surfaces guide tracks of alternate endless members of the plurality of endless members, respectively; and the second cylindrical guide surfaces guide tracks of the remaining alternate endless members of the plurality of endless members, respectively.

In the single faced corrugated pasteboard manufacturing apparatus of the present invention as set forth in an eleventh aspect, the movement regulating guide member is a movement regulating guide roll with an outer peripheral surface which rotates while abutting a side end of the endless member.

In the single faced corrugated pasteboard manufacturing apparatus of the present invention as set forth in a twelfth aspect, the outer peripheral surface of the movement regulating guide roll is formed into the shape of a recess so that the endless member travels with the side end of the endless member being fitted in the recess.

In the single faced corrugated pasteboard manufacturing apparatus of the present invention as set forth in a thirteenth aspect, an outer periphery of at least one of the pair of facing rolls which guides the endless members has a crown-shaped portion that is progressively reduced in diameter toward an axial end thereof.

In the single faced corrugated pasteboard manufacturing apparatus of the present invention as set forth in a fourteenth aspect, the crown-shaped portion comprises one crown-shaped portion provided over the entire length of the one facing roll.

In the single faced corrugated pasteboard manufacturing apparatus of the present invention as set forth in a fifteenth aspect, the one facing roll with the crown-shaped portion has a straight line portion which is constant in outer peripheral diameter, at an axially central portion thereof, and also has two crown-shaped portions which are progressively reduced in diameter, from the axially central portion toward axially opposite ends thereof.

In the single faced corrugated pasteboard manufacturing apparatus of the present invention as set forth in a sixteenth aspect, the crown-shaped portion comprises a plurality of crown-shaped portions that respectively correspond to the endless members supported on the facing roll.

Advantages of the Invention

According to the single faced corrugated pasteboard manufacturing apparatus of the present invention as set forth in the first aspect, a plurality of endless members are wound around a pair of facing rolls in the axial direction of the facing rolls. Therefore, it is not necessary to use a wide belt such as a conventional wide belt. That is, since the endless member has a remarkably narrow width compared with the prior art, it can be more easily manufactured than the wide belt and therefore belt manufacturing costs can be reduced. When any of the endless members is damaged, only the damaged endless member can be interchanged. Therefore, it is not necessary to interchange the entire wide belt, unlike the prior art. This can also reduce the running costs. Thus, it is possible to considerably reduce the running costs.

Since the endless member is extremely narrower in width than the prior art, it is not necessary to provide a negative crown-shaped portion in the belt roll or stretch roll. Therefore, a strain in the width direction of the endless member can be considerably reduced. This makes it possible to considerably reduce insufficient bonding of a single faced corrugated pasteboard sheet and occurrence of wrinkles due to an enlargement in machine width. Since the precedence control mechanism becomes unnecessary, the machine manufacturing costs can be reduced and a machine stoppage and a break in the belt due to an abnormality in the control mechanism can be prevented.

According to the single faced corrugated pasteboard manufacturing apparatus of the present invention as set forth in the second aspect, the endless member is formed into the shape of a plate. Therefore, as with the conventional wide belt, the liner board can be pressed against the medium by nip surface pressure.

According to the single faced corrugated pasteboard manufacturing apparatus of the present invention as set forth in the third aspect, the endless member is formed into the shape of a line. Therefore, pressure (nip line pressure) higher than nip surface pressure can be applied.

According to the single faced corrugated pasteboard manufacturing apparatus of the present invention as set forth in the fourth aspect, the endless members are wound around a pair of facing rolls so that they fit in the grooves of the pair of facing rolls. Therefore, meandering of the endless members can be prevented.

According to the single faced corrugated pasteboard manufacturing apparatus of the present invention as set forth in the fifth aspect, the endless members can be prevented from falling off the grooves of a pair of facing rolls.

According to the single faced corrugated pasteboard manufacturing apparatus of the present invention as set forth in the sixth aspect, the lands of the guide roll fit in the grooves of a pair of facing rolls, whereby the fall of the endless members can be prevented.

According to the single faced corrugated pasteboard manufacturing apparatus of the present invention as set forth in the seventh aspect, the track guide rolls cause adjacent endless members of the plurality of endless members to travel on tracks which partially differ from each other. Therefore, since no adjacent endless members are present to both sides of the different track portion of each track. Thus, even if adjacent endless members are arranged close to each other, a movement regulating guide member for regulating axial movement of the endless member can be provided to the side of the endless member where an adjacent endless member is not present. Axial movement of each endless member is regulated by this movement regulating guide member, whereby meandering of each endless member can be reliably suppressed.

According to the single faced corrugated pasteboard manufacturing apparatus of the present invention as set forth in the eighth aspect, the first track guide roll guides tracks of alternate endless members of the plurality of endless members, and the second track guide roll guides tracks of the remaining alternate endless members of the plurality of endless members. Therefore, by causing adjacent endless members to travel so that tracks thereof become partially different from each other, a space in which no adjacent endless member is present can be assured more widely to one side of the different track portion of each track. Hence, the movement regulating guide member for regulating axial movement of the endless member can be provided to one side of the endless member.

According to the single faced corrugated pasteboard manufacturing apparatus of the present invention as set forth in the ninth aspect, the first and second cylindrical guide surfaces are equal in radius to each other. Therefore, the circumferential speed of each of the first and second cylindrical guide surfaces can be easily caused to coincide with the travel speed of the endless member, whereby the endless member can be guided without hindrance by each of the cylindrical guide surfaces.

According to the single faced corrugated pasteboard manufacturing apparatus of the present invention as set forth in the tenth aspect, the first cylindrical guide surfaces guide tracks of alternate endless members of a plurality of endless members, and the second cylindrical guide surfaces guide tracks of the remaining alternate endless members of the plurality of endless members. Therefore, by causing adjacent endless members to travel so that tracks thereof become partially different from each other, a space in which no adjacent endless member is present can be assured to one side of the different track portion of each track. Hence, the movement regulating guide member for regulating axial movement of the endless member can be provided to one side of the endless member.

According to the single faced corrugated pasteboard manufacturing apparatus of the present invention as set forth in the eleventh aspect, the movement regulating guide member is a movement regulating guide roll with an outer peripheral surface which rotates while abutting a side end of the endless member. Therefore, travel of the endless member can be guided while suppressing the sliding between the movement regulating guide member and the endless member, whereby it becomes possible to suppress wear on the endless member.

According to the single faced corrugated pasteboard manufacturing apparatus of the present invention as set forth in the twelfth aspect, the endless member travels, with the side end of the endless member being fitted in the recess of the outer peripheral surface of the movement regulating guide roll. Therefore, meandering of the endless member can be more reliably prevented.

According to the single faced corrugated pasteboard manufacturing apparatus of the present invention as set forth in the thirteenth aspect, the outer periphery of either of a pair of facing rolls has a crown-shaped portion that is progressively reduced in diameter toward axial ends thereof. Therefore, during rotation of the facing rolls, in the crown-shaped portion, the endless member can create forces from the axial ends toward the central portion. Thus, it becomes possible to cause the axial ends to travel stably without meandering.

According to the single faced corrugated pasteboard manufacturing apparatus of the present invention as set forth in the fourteenth aspect, one crown-shaped portion is formed over the entire length of the facing roll. Therefore, during rotation of the facing roll, forces are exerted on the endless members toward the axially central portion of the facing roll, so that the endless members are moved toward the axially central portion, and travel symmetrically with respect to the axially central portion and in close proximity to each other. Thus, it becomes possible to cause the endless members to travel stably without meandering.

According to the single faced corrugated pasteboard manufacturing apparatus of the present invention as set forth in the fifteenth aspect, two crown-shaped portions which are progressively reduced in diameter are formed from the axially central portion of the facing roll toward the axially opposite ends thereof. Therefore, during rotation of the facing roll, forces are exerted on the endless members from the crown-shaped portions toward the axially central portion of the facing roll, so that the endless members are moved toward the axially central portion, and travel symmetrically with respect to the axially central portion and in close proximity to each other. Thus, it becomes possible to cause the endless members to travel stably without meandering.

According to the single faced corrugated pasteboard manufacturing apparatus of the present invention as set forth in the sixteenth aspect, forces are exerted on the axial ends of each endless member toward the central portion of each of the crown-shaped portions. Therefore, it becomes possible to cause each of the endless members to travel stably without meandering.

DESCRIPTION OF REFERENCE NUMERALS

Figure 1:
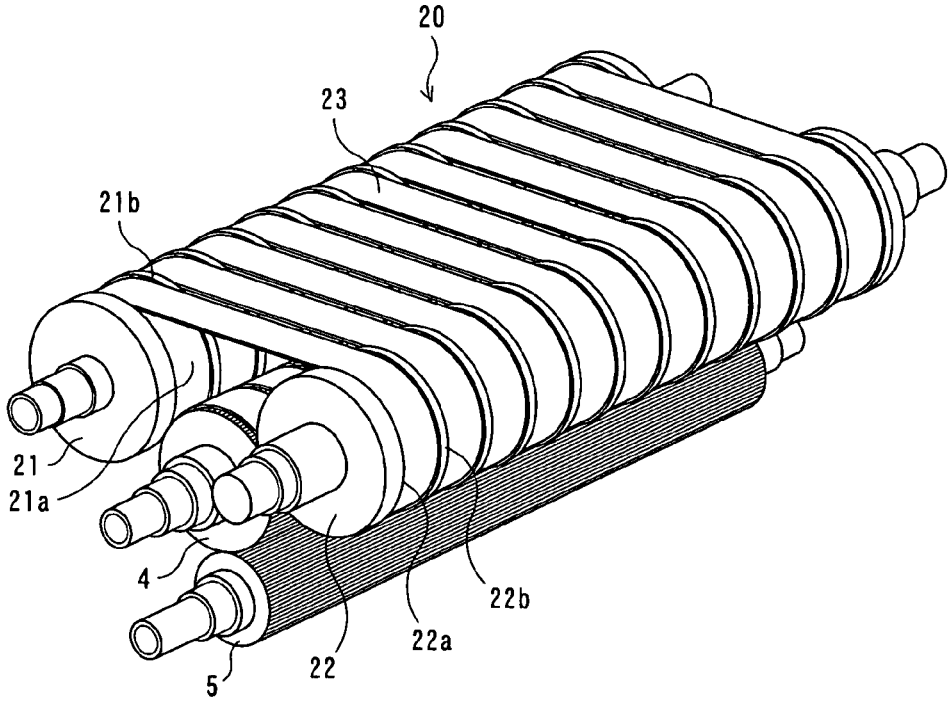
FIG. 1 is a perspective view schematically showing a single faced corrugated pasteboard manufacturing apparatus as a first embodiment of the present invention.

1 Medium
2 Liner board
3 Single faced corrugated pasteboard sheet
4 Upper corrugated roll (corrugated roll)
4*a* Ridge of upper corrugated roll
4*b* Groove of upper corrugate roll
5 Lower corrugated roll (corrugated roll)
5*a* Ridge of lower corrugated roll
5*b* Groove of lower corrugate roll
6 Bonding roll
7 Scraping roll
7*a* Scraper
8 Glue reservoir
10 Corrugating unit
11 Glue machine
20,20',20A to 20E Pressure unit
21 Belt roll
21*a* Groove
21*b* Ridge
22 Stretch roll
22*a* Groove
22*b* Ridge
23 Belt (endless member)
30 Pressure unit
31 Belt roll
31*a* Groove
31*b* Ridge
32 Stretch roll
32*a* Groove
32*b* Ridge
33 Wire (endless member)
41 Guide roll (fall preventing member)
41*a* Recess
42 Guide roll (fall preventing member)
42*a* Recess
51 Belt roll
52 Stretch roll
53 Belt (endless member)
53A,53B Belt group
53*a* End of belt 53
54 First track guide roll
54*a* First cylindrical guide surface
55 Second track guide roll
55*a* Second cylindrical guide surface
56,56' Movement regulating guide roll as a movement regulating guide member

56*a*, 56*b* Outer peripheral surface of the movement regulating guide rolls 56, 56'
57 Track guide roll
57*a* First cylindrical guide surface
57*b* Second cylindrical guide surface
58,59,60 Belt roll
531 to 538 Belt (endless member)
58*a*,59*a*,60*b* Crown-shaped portion
60*a* Straight line portion
100 Pressure unit
101 Belt roll
102 Stretch roll
103 Belt

BEST MODE FOR CARRYING OUT THE INVENTION

Embodiments of the present invention will be described hereinafter with reference to the drawings.

(A) First Embodiment

FIG. 1 is a perspective view schematically showing a single faced corrugated pasteboard manufacturing apparatus as a first embodiment of the present invention. In FIG. 1, the same parts as the conventional example previously described are given the same reference numerals. Only parts differing from the conventional example will be described hereinafter, and because the other parts are the same as the conventional example, a description of the same parts will not be given.

Figure 5:
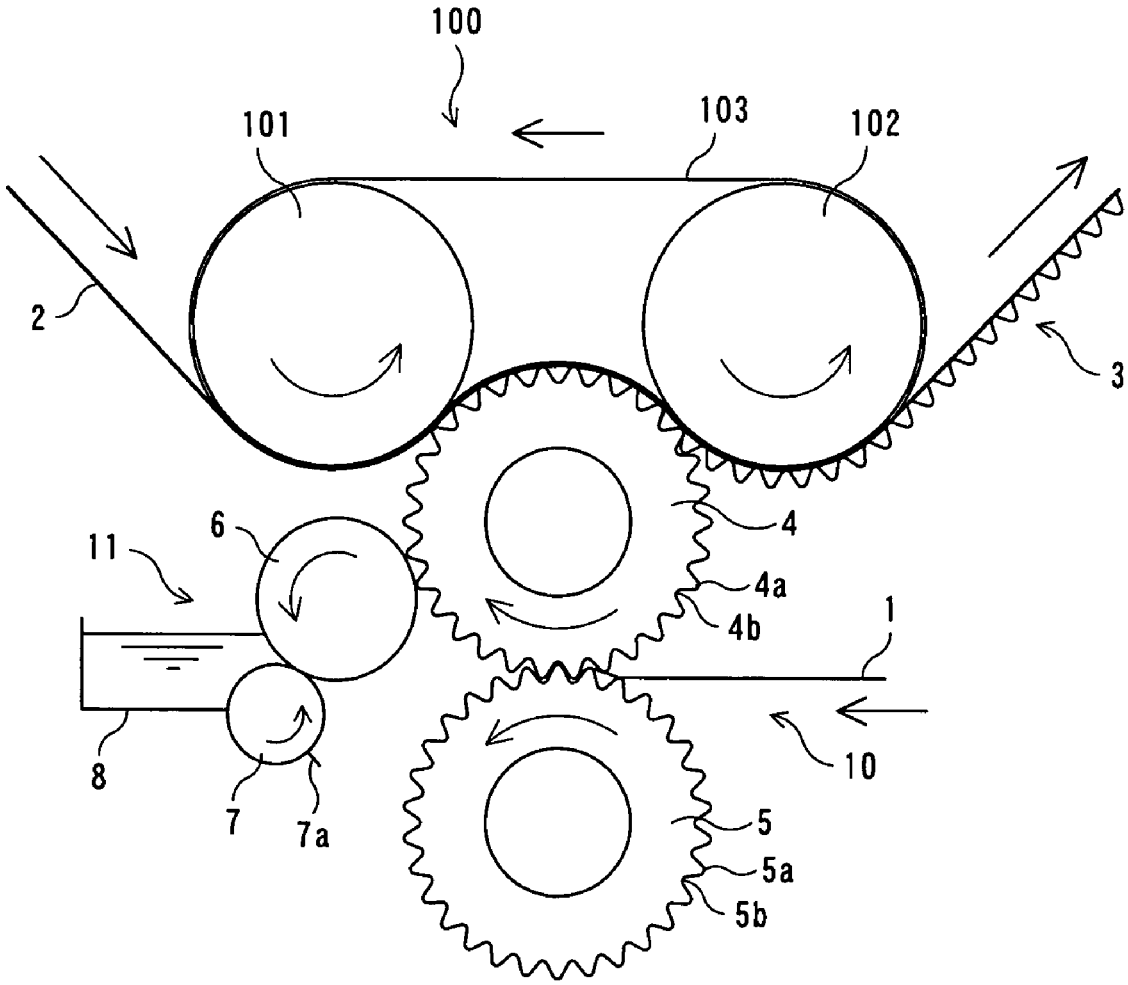
FIG. 5 is a side view schematically showing a conventional single faced corrugated pasteboard manufacturing apparatus.
Figure 6A:
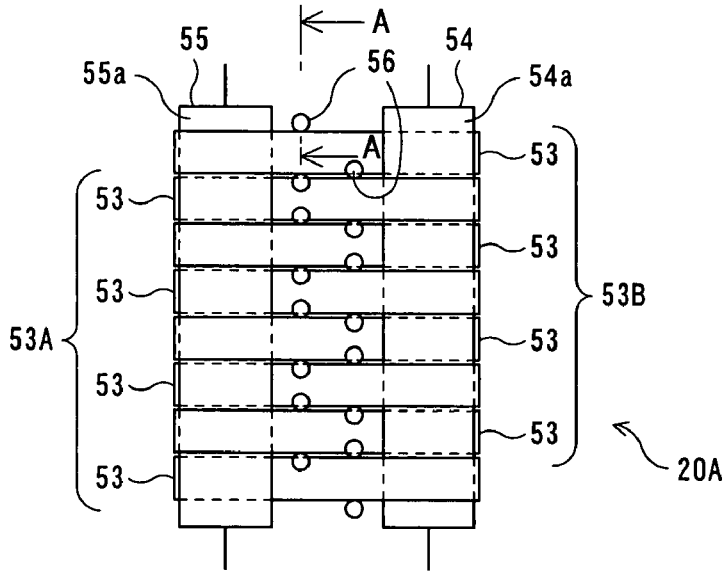
FIGS. 6(*a*) to 6(*c*) are schematic diagrams showing a single faced corrugated pasteboard manufacturing apparatus as a fourth embodiment of the present invention, FIG. 6(*a*) is a plan view of the apparatus, FIG. 6(*b*) is a side view of the apparatus, FIG. 6(*c*) is a sectional view taken along lines A-A of FIGS. 6(*a*) and 6(*b*), and FIG. 6(*d*) is a sectional view similar to FIG. 6(*c*) showing a modification of the fourth embodiment of the present invention.
Figure 6B:
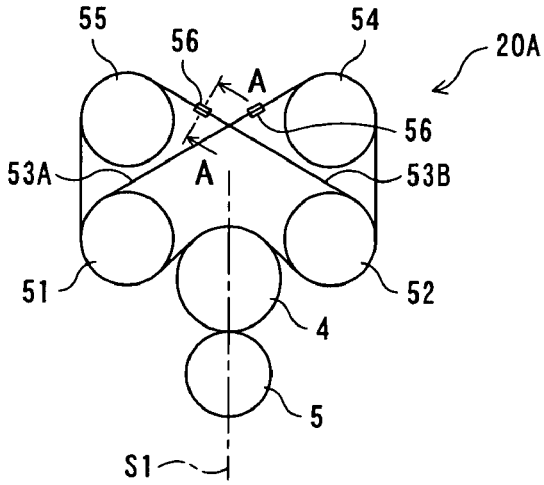
Figure 6C:
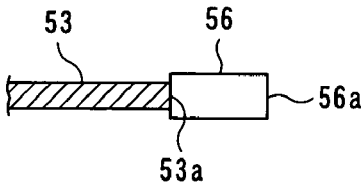
Figure 6D:
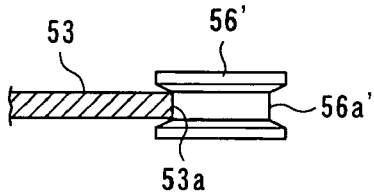

A pressure unit 20 according to this embodiment, as shown in FIG. 5 employed in the description of the conventional example, functions to press a liner board 2 against a medium 1 when bonding them together in the single faced corrugated pasteboard manufacturing apparatus in which with the medium 1 corrugated between an upper corrugated roll 4 and a lower corrugated roll 5 (a pair of corrugated rolls) being supported on the surface of the upper corrugated roll 4, the liner board 2 is glued on the medium 1 to manufacture a single faced corrugated pasteboard sheet 3.

As shown in FIG. 1, the pressure unit 20 is equipped mainly with a belt roll 21 and a stretch roll 22 as a pair of facing rolls, and a belt (endless belt) 23 wound around the belt roll 21 and stretch roll 22.

The belt roll 21 and stretch roll 22 each face the upper corrugated roll 4 and are provided in parallel to the upper corrugated roll 4. In this embodiment, the belt roll 21 is diagonally arranged to the upper stream side of the sheet conveyance direction of the upper corrugated roll 4 and the upper part of the upper corrugated roll 4, while the stretch roll 22 is diagonally arranged to the lower stream side of the sheet conveyance direction of the upper corrugated roll 4 and the upper part of the upper corrugated roll 4. However, the present invention is not limited to this positional relation. For example, there are cases where the belt roll 21 and stretch roll 22 are conversely arranged. The belt roll 21 and stretch roll 22 are spaced out, and they are constructed to rotate in the same direction by the upper corrugated roll 4 or drive unit (not shown).

The peripheral surface of the belt roll 21 has a plurality of grooves 21*a* formed in the axial direction of the belt roll 21 (machine width direction), and the peripheral surface of the stretch roll 22 also has a plurality of grooves 22*a* formed in the axial direction of the stretch roll 22 so as to correspond to the axial positions of the grooves 21*a* of the belt roll 21.

In this embodiment, the gap between the grooves 21*a* and 21*a* of the belt roll 21 (i.e., the width of a ridge 21*b* formed between the grooves 21*a* and 21*a*), and the gap between the grooves 22*a* and 22*a* of the stretch roll 22 (i.e., the width of a ridge 22*b* formed between the grooves 22*a* and 22*a*), are set to about 10 mm or less.

In this embodiment, the depth of the groove 21*a* of the belt roll 21 (i.e., the groove depth from the peripheral surface of the belt roll 21), and the depth of the groove 22*a* of the stretch roll 22 (i.e., the groove depth from the peripheral surface of the stretch roll 22), are set to the thickness of the belt 23 or greater. In addition, in this embodiment, the width of the groove 21*a* of the belt roll 21 and the width of the groove 22*a* of the stretch roll 22 are set to the width of the belt 23 or greater.

In this embodiment, the belt 23 is formed into a plate shape, and is wound around the belt roll 21 and the stretch roll 22 so that it fits in the groove 21*a* of the belt roll 21 and the groove 22*a* of the stretch roll 22 mentioned above. That is, a plurality of belts 23 are arranged at intervals (i.e., at intervals of the width of the ridge 21*b* of the belt roll 21 and ridge 22*b* of the stretch roll 22) in the machine width direction. In other words, the belt 23 according to this embodiment is constructed such that the conventional belt 103 is divided into a plurality of parts in the machine width direction. That is, the conventional belt 103, as previously described, is a single wide belt (about 2 to 3 m in width) that is continuous from one end portion in the axial direction of the belt roll 101 and stretch roll 102 (see FIG. 5) to another end portion, whereas the belt 23 according to this embodiment is formed so that the width thereof becomes extremely narrow (e.g., about 0.05 to 1 m in width) compared with the conventional belt 103.

The belt 23 is formed from a plate or textile consisting, for example, of any one or some of ferrous metal such as stainless, carbon steel, steel; non-ferrous metal such as aluminum, copper, titan, nickel, and an alloy of these; and fibers such as carbon fiber, glass fiber, ceramic fiber, aramid fiber (aromatic polyamide fiber), aromatic arylate fiber, poly-para-phenylene benzo bisu oxazole (PBO) fiber, polyether ether ketone fiber, polyamide-imide fiber, polyimide fiber, polyphenylene sulfide fiber, polybenzimidazole fiber, and liquid crystal polyester fiber. In this embodiment, the belt 23 is formed from a single layer structure consisting of a plate or textile, but it may be formed from a layered structure consisting of plates or textiles.

The above-described belts 23 travel (or rotate) in the same direction as a direction of rotation of the belt roll 21 and stretch roll 22 by rotation of the belt roll 21 and stretch roll 22, and are pressed against the top peripheral surface of the upper corrugated roll 4 (predetermined region in the circumferential direction of the upper corrugated roll 4). This causes a liner board 2 to be pressed against a medium 1 supported on the surface of the upper corrugated roll 4, and the medium 1 and the liner board 2 are glued together to manufacture a single faced corrugated pasteboard sheet 3 (see FIG. 5).

The single faced corrugated pasteboard manufacturing apparatus as the first embodiment of the present invention can obtain the following operation and advantages because it is constructed as described above. The belts 23 are arranged in the axial direction of the belt roll 21 and stretch roll 22 and are wound around the two rolls, so it is not necessary to use a wide belt such as the conventional wide belt 103. That is, since the belt 23 has a remarkably narrow width compared with the prior art, it can be more easily manufactured than the prior art and therefore costs can be reduced.

When any of the belts 23 is damaged, only the damaged belt 23 can be interchanged. Therefore, it is not necessary to interchange the entire belt 103, unlike the prior art. This can also reduce the running costs. Thus, according to this embodiment, it is possible to considerably reduce the running costs.

The belt 23 is extremely narrower in width than the prior art. Therefore, a circumferential length error in the machine width direction of the belt 23, and a strain in the width direction of the belt 23 due to the precedence of the transversely central portion of the belt 23 resulting from bending of the belt roll 21 and stretch roll 22 (an in-plane strain of the belt 23), can be considerably more reduced than the prior art. This makes it possible to considerably reduce insufficient bonding of the single faced corrugated pasteboard sheet 3 and occurrence of wrinkles due to an enlargement in machine width. Since the precedence control mechanism becomes unnecessary, the machine manufacturing costs can be reduced and a machine stoppage and a break in the belt due to an abnormality in the control mechanism can be prevented. In addition, it is not necessary to form the belt roll 21 and stretch roll 22 into a negative crown shape, unlike the prior art.

Since the belt 23 is formed into the shape of a plate or textile, it is possible to press the liner board 2 against the medium 1 by nip surface pressure, as with the conventional wide belt 103.

Since the belt 23 is wound around the belt roll 21 and the stretch roll 22 so that it fits in the groove 21*a* of the belt roll 21 and groove 22*b* of the stretch roll 22, the meandering in the machine width direction of the belt 23 can be prevented. The prior art requires, for example, a meandering prevention mechanism which tilts either the belt roll 101 or the stretch roll 102 in the machine width direction in order to prevent meandering of the belt 103 being moved. However, this embodiment does not need to be equipped with such a meandering prevention mechanism, so it becomes possible to further reduce the machine manufacturing costs.

Particularly, in the case where the belt 23 is formed from a plate, there are no flections at the places of intersection between the warp and weft such as a textile, and compared with the case where it is formed from a textile, wear is less liable to occur. Therefore, the belt's life can be further prolonged, whereby it becomes possible to further reduce the running costs.

To increase the production efficiency of corrugated pasteboard sheets, the production of ever wider sheets has been requested in recent years. The wider-sheet requirement can be met by just adding the required number of belts 23 as needed.

(B) Second Embodiment

Figure 2:
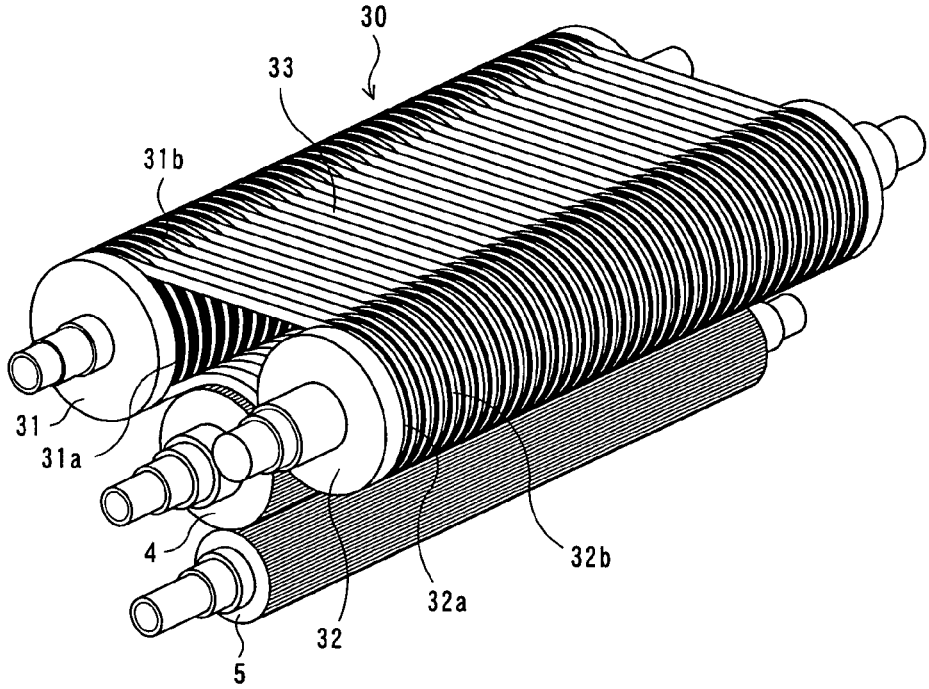
FIG. 2 is a perspective view schematically showing a single faced corrugated pasteboard manufacturing apparatus as a second embodiment of the present invention.

FIG. 2 is a perspective view schematically showing a single faced corrugated pasteboard manufacturing apparatus as a second embodiment of the present invention. In FIG. 2, the same parts as the conventional example previously described are given the same reference numerals. Only parts differing from the conventional example will be described hereinafter, and because the other parts are the same as the conventional example, a description of the same parts will not be given.

A pressure unit 30 according to this embodiment, as shown in FIG. 5 employed in the description of the conventional example, functions to press a liner board 2 against a medium 1 when bonding them together in the single faced corrugated pasteboard manufacturing apparatus in which with the medium 1 corrugated between an upper corrugated roll 4 and a lower corrugated roll 5 (a pair of corrugated rolls) being supported on the surface of the upper corrugated roll 4, the liner board 2 is glued on the medium 1 to manufacture a single faced corrugated pasteboard sheet 3.

As shown in FIG. 2, the pressure unit 30 is equipped mainly with a belt roll (also referred to as a wire roll in this embodiment) 31 and a stretch roll 32 as a pair of facing rolls, and an endless wire (endless member) 33 wound around the belt roll 31 and stretch roll 32.

The belt roll 31 and stretch roll 32 each face the upper corrugated roll 4 and are provided in parallel to the upper corrugated roll 4. In this embodiment, the belt roll 31 is diagonally arranged to the upper stream side of the sheet conveyance direction of the upper corrugated roll 4 and the upper part of the upper corrugated roll 4, while the stretch roll 32 is diagonally arranged to the lower stream side of the sheet conveyance direction of the upper corrugated roll 4 and the upper part of the upper corrugated roll 4. However, the present invention is not limited to this positional relation. For instance, there are cases where the belt roll 31 and stretch roll 32 are conversely arranged. The belt roll 31 and stretch roll 32 are spaced out, and they are constructed to rotate in the same direction by the upper corrugated roll 4 or drive unit (not shown).

The peripheral surface of the belt roll 31 has a plurality of grooves 31*a* formed in the axial direction of the belt roll 31 (machine width direction), and the peripheral surface of the stretch roll 32 also has a plurality of grooves 32*a* formed in the axial direction of the stretch roll 32 so as to correspond to the axial positions of the grooves 31*a* of the belt roll 31.

In this embodiment, the gap between the grooves 31*a* and 31*a* of the belt roll 31 (i.e., the width of a ridge 31*b* formed between the grooves 31*a* and 31*a*), and the gap between the grooves 32*a* and 32*a* of the stretch roll 32 (i.e., the width of a ridge 32*b* formed between the grooves 32*a* and 32*a*), are set to about 10 mm or less.

In this embodiment, the depth of the groove 31*a* of the belt roll 31 (i.e., the groove depth from the peripheral surface of the belt roll 31), and the depth of the groove 32*a* of the stretch roll 32 (i.e., the groove depth from the peripheral surface of the stretch roll 32), are set to the thickness of a wire 33 or greater. In addition, in this embodiment, the width of the groove 31*a* of the belt roll 31 and the width of the groove 32*a* of the stretch roll 32 are set to the width of the wire 33 or greater.

In this embodiment, the wire 33 is formed into the shape of a line, and is wound around between the belt roll 31 and the stretch roll 32 so that it fits in the groove 31*a* of the belt roll 31 and the groove 32*a* of the stretch roll 32. That is, a plurality of wires 33 are arranged at intervals (i.e., at intervals of the width of the ridge 31*b* of the belt roll 31 and ridge 32*b* of the stretch roll 32) in the machine width direction. That is, the conventional belt 103, as previously described, is a single wide belt (about 2 to 3 m wide) that is continuous from one end portion in the axial direction of the belt roll 101 and stretch roll 102 (see FIG. 5) to another end portion, whereas the wire 33 according to this embodiment is formed so that the width thereof becomes extremely narrow (e.g., about 0.001 to 0.01 m wide) compared with the conventional belt 103 (even compared with the belt 23 of the first embodiment).

The wire 33, as with the belt 23 of the first embodiment, is formed from a single wire or stranded wire (which is formed into string-like shape by twisting and entangling single wires), or a wire array (in which wires are arranged), or a plurality of stranded wires or wire arrays, which consist, for example, of any one or some of ferrous metal such as stainless, carbon steel, steel; non-ferrous metal such as aluminum, copper, titan, nickel, and an alloy of these; and fibers such as carbon fiber, glass fiber, ceramic fiber, aramid fiber (aromatic polyamide fiber), aromatic arylate fiber, poly-para-phenylene benzo bisu oxazole (PBO) fiber, polyether ether ketone fiber, polyamide-imide fiber, polyimide fiber, polyphenylene sulfide fiber, polybenzimidazole fiber, and liquid crystal polyester fiber.

The above-described wires 33 travel (or rotate) in the same direction as a direction of rotation of the belt roll 31 and stretch roll 32 by rotation of the belt roll 31 and stretch roll 32, and are pressed against the top peripheral surface of the upper corrugated roll 4 (predetermined region in the circumferential direction of the upper corrugated roll 4). This causes a liner board 2 to be pressed against a medium 1 supported on the surface of the upper corrugated roll 4, and the medium 1 and the liner board 2 are glued together to manufacture a single faced corrugated pasteboard sheet 3 (see FIG. 5).

The single faced corrugated pasteboard manufacturing apparatus as the second embodiment of the present invention is constructed as described above, and the same operation and advantages as the first embodiment are obtainable. That is, the wires 33 are arranged in the axial direction of the belt roll 31 and stretch roll 32 and are wound around the two rolls, so it is not necessary to use a wide belt such as the conventional wide belt 103. That is, since the wire 33 has an extremely narrow width compared with the prior art, it can be more easily manufactured than the prior art and therefore costs can be reduced.

When any of the wires 33 is damaged, only the damaged wire 33 can be interchanged. Therefore, it is not necessary to interchange the entire belt 103, unlike the prior art. This can also reduce the running costs. Thus, according to this embodiment, it is possible to considerably reduce the running costs.

The wire 33 of this embodiment is extremely narrower in width than the belt 23 of the first embodiment. Therefore, a circumferential length error in the machine width direction of the wire 33, and a strain in the width direction of the wire 33 due to the precedence of the transversely central portion of the wire 33 resulting from bending of the belt roll 31 and stretch roll 32 (an in-plane strain of the wire 33), are so slight as to be almost negligible. This makes it possible to considerably reduce insufficient bonding of the single faced corrugated pasteboard sheet 3 and occurrence of wrinkles due to an enlargement in machine width, compared with the conventional example and first embodiment. Since the precedence control mechanism becomes unnecessary, the machine manufacturing costs can be reduced and a machine stoppage and a break in the belt due to an abnormality in the control mechanism can be prevented. Of course, it is not necessary to form the belt roll 31 and stretch roll 32 into an negative crown shape, unlike the prior art.

Since the wire 33 is formed into the shape of a line in the present embodiment, the liner board 2 can be pressed against the medium 1 with higher pressure (nip line pressure) than the nip surface pressure obtained by the conventional belt 103 or nip surface pressure obtained by the belt 23 of the first embodiment. This makes it possible to glue together the medium 1 and liner board 2 more reliably and to further raise the bonding speed.

Since the wire 33 is wound around the belt roll 31 and the stretch roll 32 so that it fits in the groove 31*a* of the belt roll 31 and groove 32*a* of the stretch roll 32, the meandering in the machine width direction of the wire 33 can be prevented. Therefore, as with the first embodiment, this embodiment does not need to be equipped with a meandering prevention mechanism, so it becomes possible to further reduce the machine manufacturing costs.

Particularly, in the case where the wire 33 is formed from a single wire or array of wires, there is no flection due to twisting of wires such as twisted wires, and compared with the case where it is formed from a stranded wire, wear is not liable to occur. Therefore, the wire's life can be further prolonged, whereby it becomes possible to further reduce the running costs.

In addition, the wider-sheet requirement can be met by just adding the required number of wires 33 as needed.

(C) Third Embodiment

Figure 3:
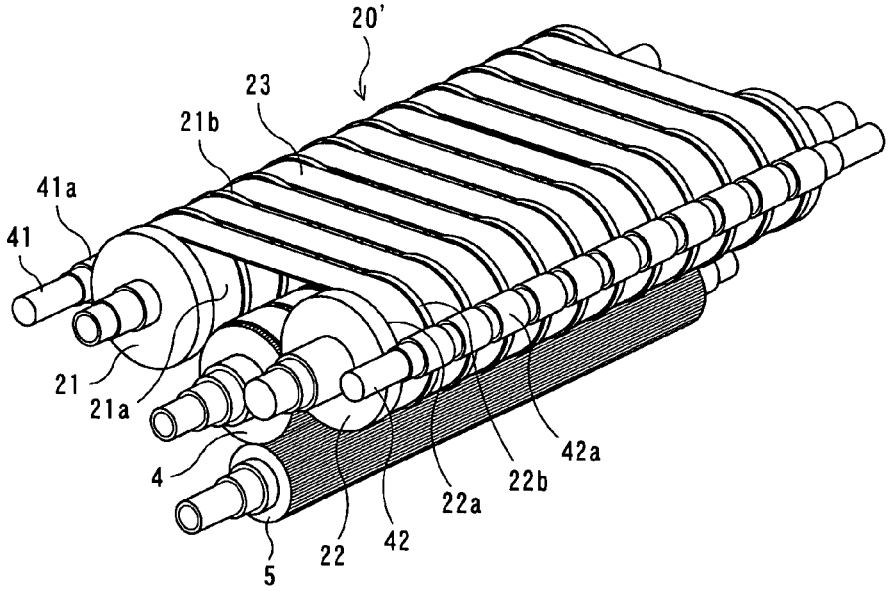
FIG. 3 is a perspective view schematically showing a single faced corrugated pasteboard manufacturing apparatus as a third embodiment of the present invention.

FIG. 3 is a perspective view schematically showing a single faced corrugated pasteboard manufacturing apparatus as a third embodiment of the present invention. In FIG. 3, the same parts as the conventional example and first embodiment previously described are given the same reference numerals. Only parts differing from the first embodiment will be described hereinafter, and because the other parts are the same as the first embodiment, a description of the same parts will not be given.

As shown in FIG. 3, a pressure unit 20' according to this embodiment is equipped with a guide roll (fall preventing member) 41 provided in parallel to a belt roll 21 and in close proximity to the belt roll 21, and a guide roll (fall preventing member) 42 provided in parallel to a stretch roll 22 and in close proximity to the stretch roll 22.

The peripheral surface of the guide roll 41 has lands 41*a* formed at positions corresponding to the grooves 21*a* of the belt roll 21. The land 41*a* is formed into the shape of a ribbon in the circumferential direction of the guide roll 41, fits in the groove 21*a* of the belt roll 21, and contacts with a belt 23 in the groove 21*a*.

The peripheral surface of the guide roll 42 also has lands 42*a* formed at positions corresponding to the grooves 22*a* of the stretch roll 22. The land 42*a* is formed into the shape of a ribbon in the circumferential direction of the guide roll 42, fits in the groove 22*a* of the stretch roll 22, and contacts with the belt 23 in the groove 22*a*.

The guide roll 41 is driven to rotate by rotation of the belt roll 21 (i.e., it rotates in a direction opposite to the belt roll 21), while the guide roll 42 is driven to rotate by rotation of the stretch roll 22 (i.e., it rotates in a direction opposite to the stretch roll 22).

The single faced corrugated pasteboard manufacturing apparatus as the third embodiment of the present invention can obtain the same operation and advantages as the first embodiment because it is constructed as described above. In addition, the guide roll 41 can prevent the belt 23 from falling off the groove 41*a* of the belt roll 41, and similarly, the guide roll 42 can prevent the belt 23 from falling off the groove 42*a* of the stretch roll 42.

For instance, during operation, even when foreign matter such as wastepaper gets in between the belt 23 and the groove 21*a* of the belt roll 21, and the belt 23 flaps and is about to fall off the groove 21*a*, the fall of the belt 23 is prevented by the guide roll 41. Similarly, during operation, even when foreign matter such as wastepaper gets in between the belt 23 and the groove 22*a* of the stretch roll 22, and the belt 23 flaps and is about to fall off the groove 22*a*, the fall of the belt 23 is prevented by the guide roll 42.

Figure 4:
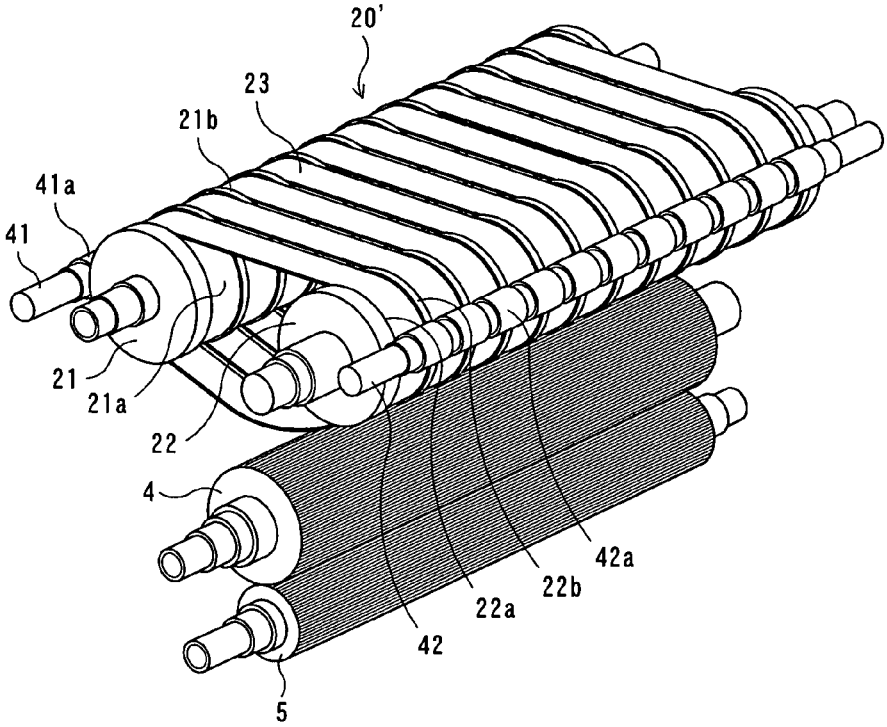
FIG. 4 is a diagram for explaining the advantages of the single faced corrugated pasteboard manufacturing apparatus as the third embodiment of the present invention, and is a perspective view showing the state in which a corrugating unit comprising an upper corrugated roll and a lower corrugated roll is lowered.

In general, when the corrugated shape of a medium (e.g., the height of a ridge, or a distance between ridges) is changed, as shown in FIG. 4, a corrugating unit comprising an upper corrugated roll 4 and a lower corrugated roll 5 is lowered and then is pulled out to an operating side (one end side in the axial direction), and another corrugating unit comprising an upper corrugated roll 4 and a lower corrugated roll 5 is inserted through the operating side and then is raised to complete interchange of the corrugating units. At this time, there is a possibility that the belt 23 will loosen and fall off the groove

21*a* of the belt roll 21 or groove 22*a* of the stretch roll 22, but by providing the guide roll 41 and guide roll 42 like this embodiment, it is also possible to prevent the fall of the belt 23.

In this embodiment, while the guide roll 41 and guide roll 42 are provided in both the belt roll 21 and the stretch roll 22, the guide roll may be provided in either of the belt and stretch rolls 21 and 22. That is, only either of the guide rolls 41 and 42 in this embodiment is provided.

As in this embodiment, if the land 41*a* of the guide roll 41 contacts the belt 23 in the groove 21*a* of the belt roll 21, it is possible to more reliably prevent the fall of the belt 23. However, if the fall of the belt 23 from the groove 21*a* can be prevented, the land 41*a* may be slightly away from the belt 23, and does not always need to contact the belt 23. By the same reason, the land 42*a* of the guide roll 42 may also be slightly away from the belt 23 in the groove 22*a* of the stretch roll 22, and does not always need to contact the belt 23.

In addition, during operation the guide roll 41 and guide roll 42 may be arranged at positions away from the belt roll 21 and stretch roll 22, and only at the interchange of corrugating units, the guide roll 41 and guide roll 42 may be arranged at positions close to the belt roll 21 and stretch roll 22 to prevent the fall of the belts 23.

Furthermore, the lands 41*a* of the guide roll 41 and lands 42*a* of the guide roll 42 are not to be limited to the above-described shape.

(D) Fourth Embodiment

FIGS. 6(*a*) to 6(*c*) are schematic diagrams showing a single faced corrugated pasteboard manufacturing apparatus as a fourth embodiment of the present invention. FIG. 6(*a*) is a plan view of the apparatus, FIG. 6(*b*) is a side view of the apparatus, and FIG. 6(*c*) is a sectional view taken along lines A-A of FIGS. 6(*a*) and 6(*b*). In FIGS. 6(*a*) to 6(*c*), the same parts as the conventional example and first embodiment previously described are given the same reference numerals. Only parts differing from the first embodiment will be described hereinafter, and because the other parts are the same as the first embodiment, a description of the same parts will not be given.

As shown in FIGS. 6(*a*) and 6(*b*), a pressure unit 20A according to this embodiment is equipped with a first track guide roll 54 disposed in parallel to a belt roll 51 and a stretch roll 52 and above the stretch roll 52, and a second track guide roll 55 disposed in parallel to the belt roll 51 and stretch roll 52 and above the belt roll 51. Note that the belt roll 51 and stretch roll 52 have no grooves such as grooves 21*a*, 22*a*, 31*a*, and 32*a* in which the endless members 23 and 33 of the above embodiments fit, and are formed into the shape of a smooth cylindrical surface. An endless member in this embodiment comprises the same belt as the first embodiment, but it may be the wire 33 such as the second embodiment.

As endless members which are wound around the belt roll 51 and stretch roll 52, a plurality of parallel belts (endless belts) 53 similar to the first embodiment are provided. Alternate belts 53A of the belts 53 are wound around the belt roll 51, stretch roll 52, and first track guide roll 54, while the remaining alternate belts 53B are wound around the belt roll 51, stretch roll 52, and second track guide roll 55.

With this arrangement, the belt group 53A travels on a track (first track) prescribed by the outer peripheral surface of the belt roll 51, outer peripheral surface of the stretch roll 52, and cylindrical guide surface 54*a* of the outer periphery of the first track guide roll 54, while the belt group 53B travels on a track (second track) prescribed by the outer peripheral surface of the belt roll 51, outer peripheral surface of the stretch roll 52, and cylindrical guide surface 55*a* of the outer periphery of the second track guide roll 55. Therefore, the belt group 53A and belt group 53B travel on tracks which are partially different from each other before and after the part which is wound around the track guide rolls 54 and 55, by the track guide rolls 54, 55.

Particularly, in this embodiment, the belt roll 51 and stretch roll 52 are disposed symmetrically with respect to a symmetrical plane S1 which is the common diameter plane of an upper corrugated roll 4 and a lower corrugated roll 5, and similarly, the first track guide roll 54 and second track guide roll 55 are disposed symmetrically with respect to the symmetrical plane S1. Of course, the first track guide roll 54 has the same outside diameter as the second track guide roll 55. Therefore, the first track prescribed by the first track guide roll 54 is equal in length to the second track prescribed by the second track guide roll 55. For this reason, the belt groups 53A, 53B comprise equal belts. Note that the first track and second track do not always need to be equal in length to each other.

Thus, since the first track and second track each have a different track portion, no adjacent belts travel to both sides of this different track portion, i.e., to both sides of the belt 53 traveling on this different track portion. Therefore, even if adjacent belts 53 are arranged closer to each other, ample spaces are assured to both sides of each belt 53. Hence, a movement regulating guide roll 56 as a movement regulating guide member is provided in each empty space to prevent meandering of each belt 53.

This movement regulating guide roll 56, as shown in FIG. 6(*c*), has an outer peripheral surface 56*a* which rotates while abutting an end 53*a* of the belt 53, and functions to guide travel of the belt 53 while suppressing the occurrence of wear due to the sliding between the movement regulating guide roll 56 and the end 53*a* of the belt 53. In this embodiment, as shown in FIG. 6(*a*), a single movement regulating guide roll 56 is provided at the same position on the track of the end 53*a* of each belt 53, but the number and arrangement of movement regulating guide rolls 56 are not limited to this embodiment.

In the example of FIG. 6(*c*), the outer peripheral surface 56*a* comprises a flat cylindrical surface, but as shown in FIG. 6(*d*), the outer peripheral surface 56' of a movement regulating guide roll 56' may be formed into the shape of a recess so that the belt 53 travels with a side end thereof fitted in the recess formed in the recessed outer peripheral surface of the movement regulating guide roll. In this case, the recess in the outer peripheral surface 56' can regulate runout in the width direction of the belt 53, whereby meandering of the belt 53 can be prevented more reliably. However, if the outer peripheral surface 56' of the movement regulating guide roll 56' is formed into a groove, the end 53*a* of the belt 53 slides on the both recessed side walls of the groove and therefore is liable to wear. Because of this, the belt end 53*a* is liable to wear. Therefore, as shown in FIG. 6(*d*), it is preferable to widen the recessed side wall portions in the outer peripheral surface 56*a*' into a tapered surface which is widened outwardly in the width direction of the belt 53 so that the end 53*a* of the belt 53 does not easily wear.

Thus, since this embodiment is equipped with the movement regulating guide rolls 56 and 56', grooves such as grooves 21*a*, 22*a*, 31*a*, and 32*a* in which the endless members 23 and 33 of the above embodiments fit become unnecessary. As a result, the outer peripheries of the belt roll 51 and stretch roll 52 are formed into the shape of a flat cylindrical surface.

The single faced corrugated pasteboard manufacturing apparatus as the fourth embodiment of the present invention can obtain the same operation and advantages as the first embodiment, because it is constructed as described above. In addition, the movement regulating guide rolls 56, 56' prevent axial movement of each belt 53, thereby preventing meandering of each belt 53 during travel. Particularly, as in the first, second, and third embodiments, in the case where the belt roll and stretch roll are provided with grooves (grooves 21*a*, 22*a*, 31*a*, and 32*a*) in which the belts fit, ridges (ridges 21*b*, 22*b*, 31*b*, and 32*b*) for forming grooves are provided and therefore the grooves must be spaced out to some degree. In the structure of this embodiment, at the places of the different track portions of the first and second tracks, the movement regulating guide roll 56 is provided in the space formed to one side of each belt 35, whereby adjacent belts 53 can be arranged axially closer to each other. In addition, in the structure of regulating meandering of the belt with grooves, the belt is liable to wear because of sliding between the belt and the grooves, but the structure of this embodiment can easily suppress wear on the belt.

(E) Fifth Embodiment

Figure 7A:
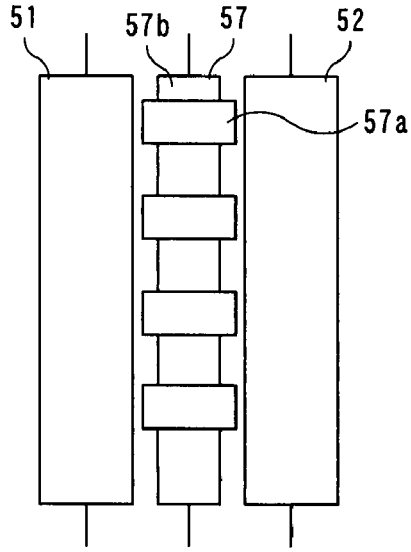
FIGS. 7(*a*) to 7(*c*) are schematic diagrams showing a single faced corrugated pasteboard manufacturing apparatus as a fifth embodiment of the present invention, FIG. 7(*a*) is a plan view showing the apparatus, with endless members being removed, FIG. 7(*b*) is a plan view of the apparatus, and FIG. 7(*c*) is a side view of the apparatus.
Figure 7B:
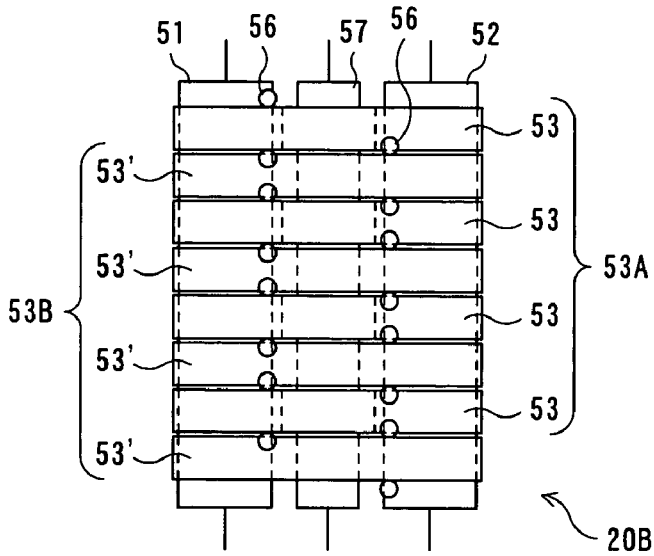
Figure 7C:
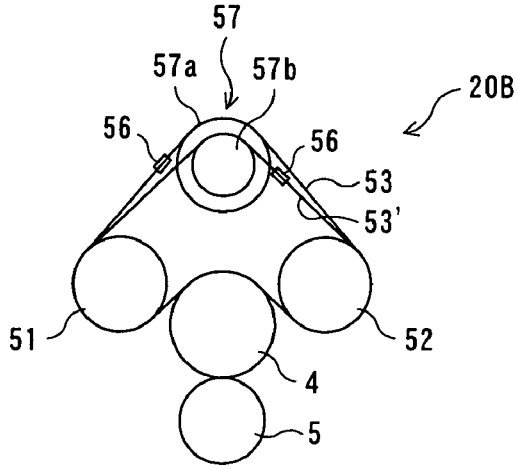

FIGS. 7(*a*) to 7(*c*) are schematic diagrams showing a single faced corrugated pasteboard manufacturing apparatus as a fifth embodiment of the present invention. FIG. 7(*a*) is a plan view showing the apparatus, with endless belts being removed; FIG. 7(*b*) is a plan view of the apparatus; and FIG. 7(*c*) is a side view of the apparatus. Only parts differing from the fourth embodiment will be described hereinafter, and because the other parts are the same as the fourth embodiment, a description of the same parts will not be given.

As shown in FIGS. 7(*b*) and 7(*c*), a pressure unit 20B according to this embodiment is equipped with a track guide roll 57, which is disposed in parallel to a belt roll 51 and a stretch roll 52 and above the belt roll 51 and stretch roll 52. Note that the belt roll 51 and stretch roll 52 do not have grooves such as grooves 21*a*, 22*a*, 31*a*, and 32*a* in which the endless members 23 and 33 of the above first, second, and third embodiments fit, and are formed into the shape of a smooth cylindrical surface. An endless member in this embodiment comprises the same belt as the first embodiment, but it may be the wire 33 such as the second embodiment.

The track guide roll 57 has first cylindrical guide surfaces 57*a* and second cylindrical guide surfaces 57*b*, which are different in diameter from each other and are formed alternately in the axial direction of the track guide roll 57. As endless members that are wound around the belt roll 51, stretch roll 52 and track guide roll 57, a plurality of belts (endless belts) 53 and 53' similar to the first embodiment are provided in parallel to each other. In this embodiment, the first cylindrical guide surface 57*a* is larger in diameter than the second cylindrical guide surface 57*b*, but they may be reversed.

Alternate belts 53A of the belts 53 and 53' are wound around the outer peripheral surface of the belt roll 51, outer peripheral surface of the stretch roll 52, and first cylindrical guide surface 57*a* of the track guide roll 57, while the remaining alternate belts 53B of the plurality of belts 53, 53' are wound around the outer peripheral surface of the belt roll 51, outer peripheral surface of the stretch roll 52, and second cylindrical guide surface 57*b* of the track guide roll 57.

With this arrangement, the belt group 53A travels on a track (first track) prescribed by the belt roll 51, stretch roll 52, and first cylindrical guide surface 57*a* of the track guide roll 57, while the belt group 53B travels on a track (second track) prescribed by the belt roll 51, stretch roll 52, and second cylindrical guide surface 57*b* of the track guide roll 57. Therefore, the belt group 53A and belt group 53B travel on tracks which are partially different from each other before and after the part which is wound around these cylindrical guide surfaces 57*a* and 57*b*, by the cylindrical guide surfaces 57*a*, 57*b*.

Thus, since the first track and second track each have a different track portion, no adjacent belts travel to both sides of this different track portion, i.e., both sides of the belt 53 or 53' traveling on this different track portion. Therefore, even if adjacent belts 53 or 53' are arranged close to each other, ample spaces are assured to both sides of each belt 53 or 53'. Hence, a movement regulating guide roll 56 as a movement regulating guide member is provided in each empty space to prevent meandering of each belt 53 or 53'.

Since this movement regulating guide roll 56 is the same as the fourth embodiment, a description of the guide roll 56 will not be given.

Note that the wall portions of the first cylindrical guide surface 57*a* are erected at both side edges of the second cylindrical guide surface 57*b*. For this reason, the width of the second cylindrical guide surface 57*b* is made larger than that of the belt 53' so that the side ends of the belt 53' do not contact the wall portions on both sides of the second cylindrical guide surface 57*b*. This prevents wear on the side ends of the belt 53' from easily occurring.

The single faced corrugated pasteboard manufacturing apparatus as the fifth embodiment of the present invention can obtain the same operation and advantages as the first embodiment, because it is constructed as described above. As with the fourth embodiment, the fifth embodiment can further obtain the advantage of preventing axial movement of the belts 53, 53' by the movement regulating guide rolls 56, 56' to prevent meandering of the belts 53, 53' during travel, the advantage of being able to arrange adjacent belts 53, 53' closer to each other, and the advantage of easily suppressing wear on the belts 53, 53'. In addition, compared with the fourth embodiment, this embodiment can be made structurally simpler because it employs only one track guide roll 57.

(F) Sixth Embodiment

Figure 8A:
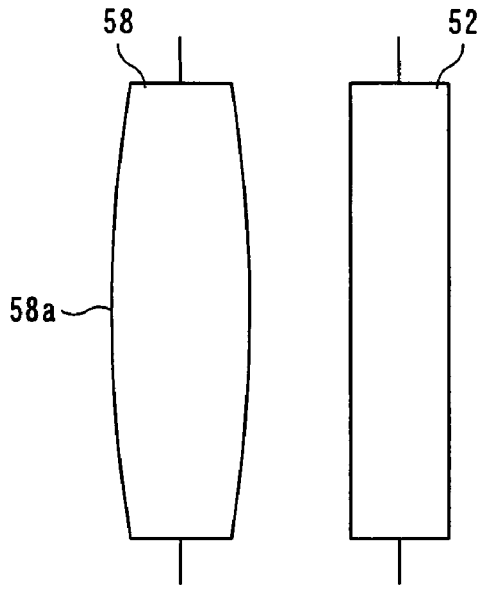
FIGS. 8(*a*) to 8(*c*) are schematic diagrams showing a single faced corrugated pasteboard manufacturing apparatus as a sixth embodiment of the present invention, FIG. 8(*a*) is a plan view showing the apparatus, with endless members being removed, FIG. 8(*b*) is a plan view of the apparatus, and FIG. 8(*c*) is a side view of the apparatus.
Figure 8B:
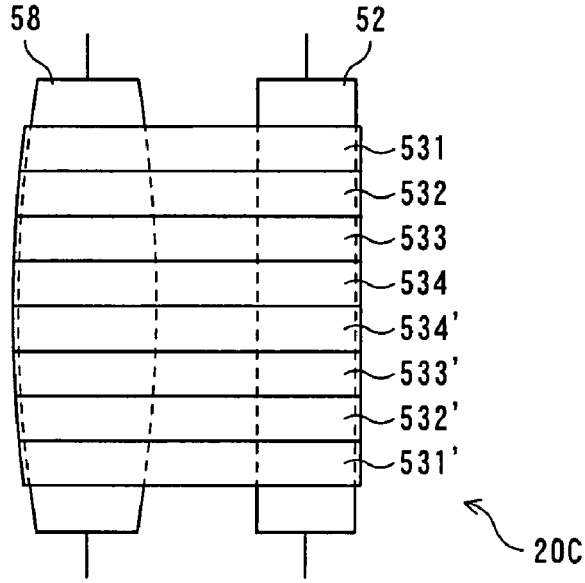
Figure 8C:
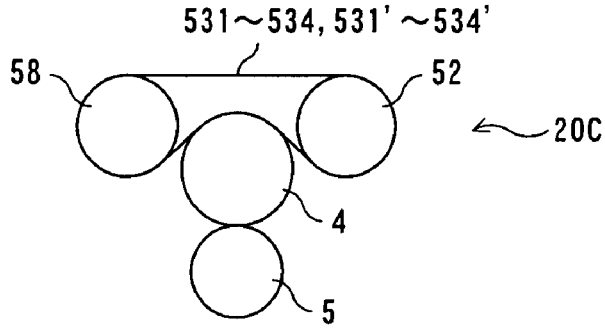

FIGS. 8(*a*) to 8(*c*) are schematic diagrams showing a single faced corrugated pasteboard manufacturing apparatus as a sixth embodiment of the present invention. FIG. 8(*a*) is a plan view showing the apparatus, with endless belts being removed; FIG. 8(*b*) is a plan view of the apparatus, and FIG. 8(*c*) is a side view of the apparatus. Only parts differing from the first embodiment will be described hereinafter, and because the other parts are the same as the first embodiment, a description of the same parts will not be given.

As shown in FIGS. 8(*a*) to 8(*c*), in a pressure unit 20C according to this embodiment, between a belt roll 58 and a stretch roll 52 which function as a pair of facing rolls, the outer peripheral surface of the belt roll 58 is formed into a crown-shaped portion 58*a* which is progressively reduced in diameter toward the axially opposite ends thereof. As endless members that are wound around the belt roll 58 and stretch roll 52, the same endless belts 531 to 534 and 531' to 534' as the first embodiment have inner peripheral surfaces which contact the crown-shaped portion 58*a* of the belt roll 58 and outer peripheral surface of the stretch roll 52 over approximately the entire width.

Note that the belt roll 58 and stretch roll 52 do not have grooves such as grooves 21*a*, 22*a*, 31*a*, and 32*a* in which the endless members 23, 33 of the above embodiments fit. In this embodiment, the endless member is the same belt as the first embodiment, but it may be a wire such as the wire 33 of the second embodiment.

In FIGS. 8(*a*) and 8(*b*), the crown shape is enlarged so that the diameter of the central portion of the belt roll 58 becomes extremely larger than that of the end portion, but in actuality, there isn't so much difference. In addition, FIG. 8(*c*) is used for explaining the configuration of the rolls, so the belt roll 58 is described to be uniform in diameter without showing the crown shape.

The single faced corrugated pasteboard manufacturing apparatus as the sixth embodiment of the present invention can obtain the same operation and advantages as the first embodiment, because it is constructed as described above. In addition, during rotation of the belt roll 58 and stretch roll 52 facing each other, the crown-shaped portion 58*a* can cause the belts 531 to 534 and 531' to 534' to create forces from the axially opposite ends of the belt roll 58 toward the axially central portion. As a result, it becomes possible to cause the belts 531 to 534 and 531' to 534' to travel stably without meandering.

In the case of this embodiment, if the belts 531 to 534 and 531' to 534' are formed as metal belts such as steel belts, they can travel stably without stranding (meandering), because they are high in rigidity.

In this embodiment, while eight belts (531 to 534 and 531' to 534') have been illustrated and described, the present invention is not limited to the total number.

(G) Seventh Embodiment

Figure 9A:
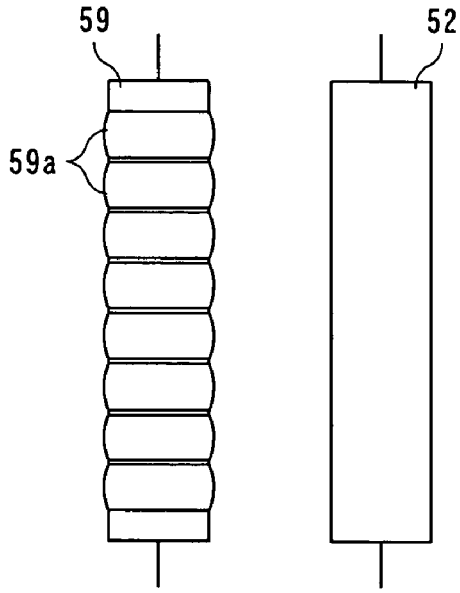
FIGS. 9(*a*) to 9(*c*) are schematic diagrams showing a single faced corrugated pasteboard manufacturing apparatus as a seventh embodiment of the present invention, FIG. 9(*a*) is a plan view showing the apparatus, with endless members being removed, FIG. 9(*b*) is a plan view of the apparatus, and FIG. 9(*c*) is a side view of the apparatus.
Figure 9B:
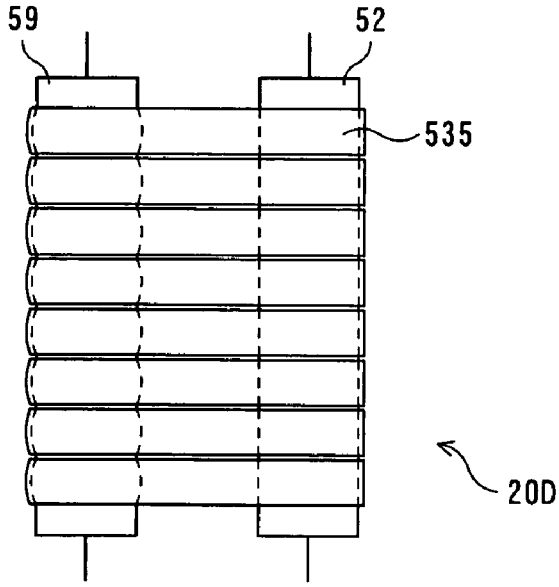
Figure 9C:
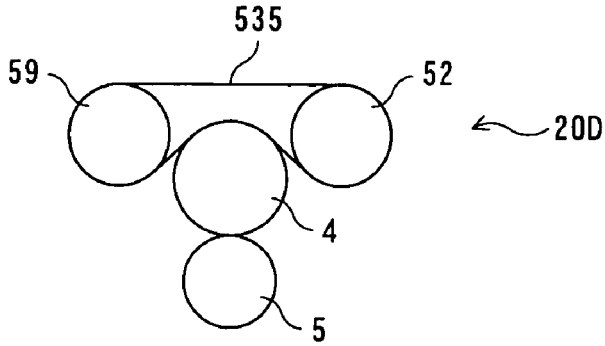

FIGS. 9(*a*) to 9(*c*) are schematic diagrams showing a single faced corrugated pasteboard manufacturing apparatus as a seventh embodiment of the present invention. FIG. 9(*a*) is a plan view showing the apparatus, with endless belts being removed; FIG. 9(*b*) is a plan view of the apparatus; and FIG. 9(*c*) is a side view of the apparatus. Only parts differing from the sixth embodiment will be described hereinafter, and because the other parts are the same as the sixth embodiment, a description of the same parts will not be given.

In a pressure unit 20D of this embodiment, as shown in FIGS. 9(*a*) to 9(*c*), between a belt roll 58 and a stretch roll 52 which function as a pair of facing rolls, the outer peripheral surface of the belt roll 59 is formed into a plurality of crown-shaped portions 59*a*, each of which is progressively reduced in diameter toward the axially opposite ends thereof. The crown-shaped portions 59*a* correspond to endless members (endless belt) 535, respectively. Each of the belts 535 is wound around the belt roll 59 and stretch roll 52 and has an inner peripheral surface which contacts the crown-shaped portion 59*a* of the belt roll 59 and outer periphery of the stretch roll 52 over approximately the entire width of the inner peripheral surface.

Note that the belt roll 59 and stretch roll 52 do not have grooves such as grooves 21*a*, 22*a*, 31*a*, and 32*a* in which the endless members 23, 33 of the above embodiments fit. In this embodiment, the endless member is the same belt as the first embodiment, but it may be a wire such as the wire 33 of the second embodiment.

The single faced corrugated pasteboard manufacturing apparatus as the seventh embodiment of the present invention can obtain the same operation and advantages as the sixth embodiment, because it is constructed as described above. That is, forces directed toward the central portion of the crown-shaped portion occur in the axial ends of each belt 535. As a result, axial movement of each belt 535 along the crown-shaped portion is regulated, and it becomes possible to cause each belt to travel stably without meandering.

(H) Eighth Embodiment

Figure 10A:
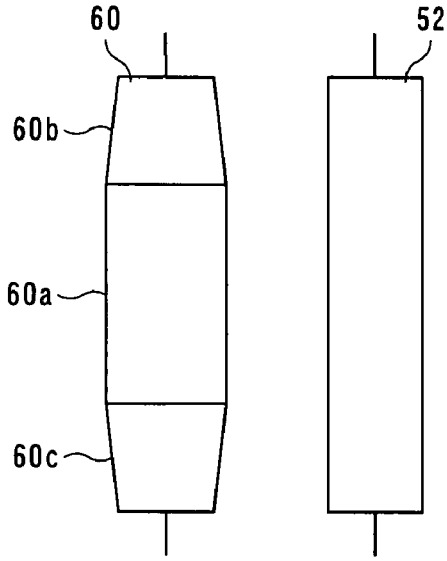
FIGS. 10(*a*) to 10(*c*) are schematic diagrams showing a single faced corrugated pasteboard manufacturing apparatus as an eighth embodiment of the present invention, FIG. 10(*a*) is a plan view showing the apparatus, with endless members being removed, FIG. 10(*b*) is a plan view of the apparatus, and FIG. 10(*c*) is a side view of the apparatus.
Figure 10B:
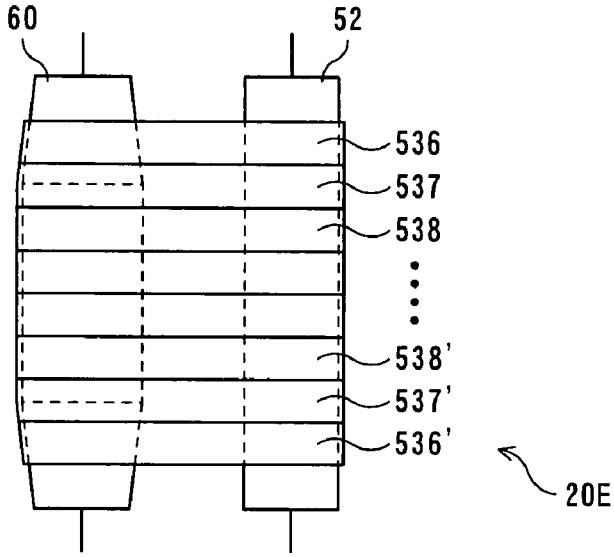
Figure 10C:
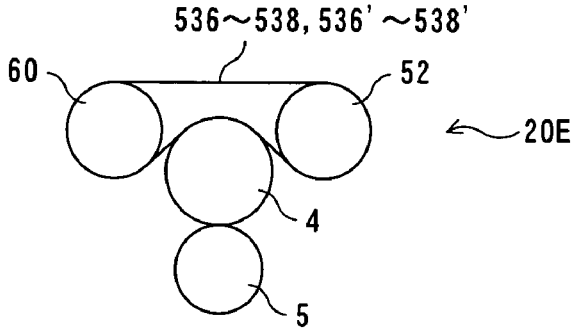

FIGS. 10(*a*) to 10(*c*) are schematic diagrams showing a single faced corrugated pasteboard manufacturing apparatus as an eighth embodiment of the present invention. FIG. 10(*a*) is a plan view showing the apparatus, with endless belts being removed; FIG. 10(*b*) is a plan view of the apparatus; and FIG. 10(*c*) is a side view of the apparatus. Only parts differing from the sixth embodiment will be described hereinafter, and because the other parts are the same as the sixth embodiment, a description of the same parts will not be given.

In a pressure unit 20E of this embodiment, as shown in FIGS. 10(*a*) to 10(*c*), between a belt roll 60 and a stretch roll 52 which function as a pair of facing rolls, the axially central portion of the outer periphery of the belt roll 60 is formed into a straight line portion 60*a* which is constant in diameter. The axially opposite portions of the outer periphery of the belt roll 60 are formed into crown-shaped portions 60*b* that is progressively reduced in diameter.

As endless members which are wound around the belt roll 60 and stretch roll 52, endless belts 536, 537, 536', and 537' similar to the first embodiment are formed so that the length of one side end in the belt width direction is slightly longer or shorter than that of the other side end. Endless belts 538, . . . , 538 are formed the same as the first embodiment. The inner peripheral surfaces of the endless belts 536 and 537, 536' and 537', and 538 contact the straight line portion 60*a* and crown-shaped portions 60*b* of the belt roll 60 and outer periphery of the stretch roll 52 over approximately the entire width.

Note that the belt roll 60 and stretch roll 52 do not have grooves such as grooves 21*a*, 22*a*, 31*a*, and 32*a* in which the endless members 23, 33 of the above embodiments fit. In this embodiment, the endless member is the same belt as the first embodiment, but it may be a wire such as the wire 33 of the second embodiment.

In FIGS. 10(*a*) and 10(*b*), the crown shape is enlarged so that the diameter of the central portion of the belt roll 60 becomes extremely larger than that of the end portion, but in actuality, there isn't so much difference. In addition, FIG. 10(*c*) is used for explaining the configuration of the rolls, so the belt roll 60 is described to be uniform in diameter without showing the crown shape.

The single faced corrugated pasteboard manufacturing apparatus as the eighth embodiment of the present invention can obtain the same operation and advantages as the sixth embodiment, because it is constructed as described above. That is, in the crown-shaped portions 60*b*, forces directed toward the central portion of the belt roll 60 (toward straight line portion 60*a*) occur in the axial ends of the belts 536, 537. As a result, axial movement of each of the belts 536, 537, 536', and 537' to the axial ends of the belt roll 60 is prevented, and the belts 538 on the straight line portion 60*a* of the belt roll 60 are held toward the central portion by the crown-shaped portions 60*b* and 60*c*. Thus, it becomes possible to cause belts 536, 537, 536', 537', and 538 to travel stably without meandering.

As with the above-described embodiments, if the belts 531~534 are formed as metal belts such as steel belts, they can travel stably without stranding (meandering), because they are high in rigidity.

(I) Others

While the present invention has been described with reference to the preferred embodiments thereof, the invention is not to be limited to the details given herein, but may be modified within the scope of the invention hereinafter claimed.

For example, in the first and third embodiments, while the grooves 21*a* and 22*a* are provided in the belt roll 21 and stretch roll 22, the grooves 21*a* and 22 do not need to be provided, if there is no meandering of the belts 23. Alternatively, the grooves 21*a* or 22*a* may be provided in either the belt roll 21 or the stretch roll 22 according to the degree of meandering of the belts 23.

Likewise, in the second embodiment, while the grooves 31*a* and 32*a* are provided in the belt roll 31 and stretch roll 32, the grooves 31*a* and 32*a* do not need to be provided, if there is no meandering of the belts 23. Alternatively, the grooves 21*a* or 22*a* may be provided in either the belt roll 31 or the stretch roll 32 according to the degree of meandering of the wire 33.

Of course, either or both of the guide rolls 41 and 42 of the third embodiment may be provided in the pressure unit 30 of the second embodiment to prevent the fall of the wires 33. In this case, it is a matter of course that the lands 41*a* of the guide roll 41 are formed so as to fit in the grooves 31*a* of the belt roll 31, and the lands 42*a* of the guide roll 42 are formed so as to fit in the grooves 32*a* of the stretch roll 32.

In the third embodiment, rolls without lands 41*a* and 42*a* may be provided in place of the guide rolls 41 and 42. In this case, to prevent the fall of the belts 23, a roll with no land is arranged to contact the outer peripheral surface of the belt roll 21, not the belt 23.

In addition, in the third embodiment, non-rotatable guide bars without lands 41*a* and 42*a* may be provided in place of the guide rolls 41 and 42. However, in this case, it is preferable to prevent the fall of the belts 23, by arranging, during operation, non-rotatable guide bars at positions away from the belt roll 21 and stretch roll 22 so that they do not interfere with rotation of the belt roll 21 and stretch roll 22, and causing the guide bars to contact the outer peripheral surfaces of the belt roll 21 and stretch roll 22 at the unit interchange time when the belts 23 are liable to fall.

In the first through the eighth embodiments, a sensor may be provided for detecting a break in each belt or wire, and when a break is detected by this sensor, an alarm may be issued, or operation may be stopped.

A combination of belts and wires may be provided. This can simultaneously create nip surface pressure by belts and nip line pressure by wires, whereby it is possible to perform more effective bonding.

Finally, in the sixth through the eighth embodiments, while each belt is wound around two rolls, the number of rolls around which belts are wound may be three or more, if at least any one roll has a crown-shaped portion. Of course, all rolls may have a crown-shaped portion.

What is claimed is:

1. A single faced corrugated pasteboard manufacturing apparatus, comprising:

a pair of corrugated rolls for corrugating a medium, supporting the corrugated medium on a surface of one corrugated roll of said pair of corrugated rolls, and bonding a liner board on said medium being supported to manufacture a single faced corrugated pasteboard sheet, a pair of facing rolls provided to face said one corrugated roll and rotatable in a same direction each other, said pair of facing rolls having a plurality of grooves formed axially in peripheral surfaces thereof, a plurality of endless members wound around said pair of facing rolls in an axial direction of said facing rolls so that the endless members fit in said grooves of said pair of facing rolls, said endless members pressing said liner board against said medium being supported on the surface of said one corrugated roll, and a fall preventing member, provided in close proximity to at least one of said pair of facing rolls, for preventing said endless members from falling off said grooves of said pair of facing rolls, wherein said fall preventing member is a guide roll arranged in parallel to said pair of facing rolls and having lands formed on a peripheral surface thereof so as to fit in said grooves.

2. The single faced corrugated pasteboard manufacturing apparatus as set forth in claim 1, wherein each of said endless members is formed into a shape of a plate.

3. The single faced corrugated pasteboard manufacturing apparatus as set forth in claim 1, wherein each of said endless members has a narrow shape.

4. The single faced corrugated pasteboard manufacturing apparatus as set forth in claim 1, further comprising:

one or more track guide rolls, provided in parallel to said pair of facing rolls, for supporting said plurality of endless members and guiding tracks of said plurality of endless members;

said one or more track guide rolls causing adjacent endless members of said plurality of endless members to travel on tracks which partially differ from each other; and a movement regulating guide member, provided to one side of a different track portion of the track of each of the endless members which differs from the track of an adjacent endless member, for regulating axial movement of said endless member.

5. The single faced corrugated pasteboard manufacturing apparatus as set forth in claim 4, wherein said track guide rolls comprise a first track guide roll having a first cylindrical guide surface for guiding said endless members to a first track, and a second track guide roll having a second cylindrical guide surface for guiding said endless members to a second track;

said first track guide roll guides tracks of alternate endless members of said plurality of endless members; and said second track guide roll guides tracks of the remaining alternate endless members of said plurality of endless members.

6. The single faced corrugated pasteboard manufacturing apparatus as set forth in claim 5, wherein said first and second cylindrical guide surfaces are equal in radius to each other.

7. The single faced corrugated pasteboard manufacturing apparatus as set forth in claim 4, wherein said track guide roll has a plurality of first cylindrical guide surfaces alternately arranged axially for guiding said endless members to a first track, and a plurality of second cylindrical guide surfaces alternately arranged axially for guiding said endless members to a second track;

said first cylindrical guide surfaces guide tracks of alternate endless members of said plurality of endless members, respectively; and said second cylindrical guide surfaces guide tracks of the remaining alternate endless members of said plurality of endless members, respectively.

8. The single faced corrugated pasteboard manufacturing apparatus as set forth in claim 4, wherein said movement regulating guide member is a movement regulating guide roll with an outer peripheral surface which rotates while abutting a side end of said endless member.

9. The single faced corrugated pasteboard manufacturing apparatus as set forth in claim 8, wherein said outer peripheral surface of said movement regulating guide roll is formed into a shape of a recess so that said endless member travels with the side end of said endless member being fitted in said recess.

10. The single faced corrugated pasteboard manufacturing apparatus as set forth in claim 1, wherein an outer periphery of at least one of said pair of facing rolls which guides said endless members has a crown-shaped portion that is progressively reduced in diameter toward an axial end thereof.

11. The single faced corrugated pasteboard manufacturing apparatus as set forth in claim 10, wherein said crown-shaped portion comprises one crown-shaped portion provided over an entire length of said one facing roll.

12. The single faced corrugated pasteboard manufacturing apparatus as set forth in claim 10, wherein said one facing roll with said crown-shaped portion has a straight line portion which is constant in outer peripheral diameter, at an axially central portion thereof, and also has two crown-shaped portions which are progressively reduced in diameter, from said axially central portion toward axially opposite ends thereof.

13. The single faced corrugated pasteboard manufacturing apparatus as set forth in claim 10, wherein said crown-shaped portion comprises a plurality of crown-shaped portions that respectively correspond to said endless members supported on said facing roll.

14. The single faced corrugated pasteboard manufacturing apparatus as set forth in claim 1, wherein surfaces of said endless members which engage said liner board are flat and wherein said lands on said guide roll, which roll on surfaces of said endless members to retain the endless members in said grooves, are correspondingly flat.

15. The single faced corrugated pasteboard manufacturing apparatus as set forth in claim 1, wherein said lands on said guide roll, roll on surfaces of said endless members with a pressure sufficient only to retain the endless members in said grooves.

16. The single faced corrugated pasteboard manufacturing apparatus as set forth in claim 1, wherein surfaces of said lands on said guide roll, are spaced from surfaces of said endless members to retain the endless members in said grooves.

* * * * *